US006165614A

United States Patent [19]

Stiller et al.

[11] Patent Number: 6,165,614

[45] Date of Patent: Dec. 26, 2000

[54] MONOFILAMENTS BASED ON POLYETHYLENE-2,6-NAPHTHALATE

[75] Inventors: Joachim Stiller, Augsburg; Rex Delker, Wehringer; Dipl.-Ing Hans-Joachim Brüning, Augsburg, all of Germany

[73] Assignee: Johns Manville International, Inc., Denver, Colo.

[21] Appl. No.: 09/344,136

[22] Filed: Jun. 24, 1999

[30] Foreign Application Priority Data

Jun. 26, 1998 [DE] Germany ..... 198 28 517

[51] Int. Cl.[7] ..... D01F 6/00; D01F 8/00

[52] U.S. Cl. ..... 428/364; 428/373

[58] Field of Search ..... 428/364, 373; 525/444

[56] References Cited

U.S. PATENT DOCUMENTS

| | | | |
|---|---|---|---|
| 3,546,320 | 12/1970 | Duling | 260/860 |
| 3,937,754 | 2/1976 | Shimotsuma et al. | 260/860 |
| 4,026,973 | 5/1977 | Shima et al. | 264/275 |
| 4,386,174 | 5/1983 | Cogswell et al. | 524/27 |
| 5,006,613 | 4/1991 | Shepherd et al. | 525/441 |
| 5,246,992 | 9/1993 | Wick et al. | 524/195 |
| 5,688,874 | 11/1997 | Hoffman | 525/444 |
| 5,692,938 | 12/1997 | Reither | 442/199 |
| 5,902,539 | 5/1999 | Schmidt et al. | 525/444 |
| 5,910,363 | 6/1999 | Rogers | 525/444 |

FOREIGN PATENT DOCUMENTS 2008598 6/1979 United Kingdom .

OTHER PUBLICATIONS

Römpp Chemie Lexikon by Prof. Dr. Falbe and Prof. Dr. Regitz, 1990, pp. 1395–1396 entitled Liquid Crystalline Polymers.

*Primary Examiner*—Newton Edwards
*Attorney, Agent, or Firm*—Burns, Doane, Swecker & Mathis, L.L.P.

[57] ABSTRACT

Monofils based on polyethylene-2,6-naphthalate are described containing 60 to 99.9 wt-percent polyethylene-2,6-naphthalate, 0.1 to 10 wt-percent of one or more liquid crystalline polymers, 0 to 15 wt-percent polybutylene terephthalate and 0 to 3 wt-percent of an inhibitor, as well as optionally additional additives, as is a melt-spinning process for producing the same. The filaments are characterized by good mechanical properties, in particular improved knot strength and resistance to hydrolysis. They are suited primarily for making screens, filters and reinforcing inlays.

21 Claims, No Drawings

MONOFILAMENTS BASED ON POLYETHYLENE-2,6-NAPHTHALATE

DESCRIPTION

The invention relates to monofils (i.e., monofilaments) based on polyesters, namely polyethylene-2,6-naphthalate, which contain liquid crystalline polymers as admixtures, their preparation and their use, in particular for the manufacture of papermaking machine screens or cloth.

Monofil in the context of the invention means an endless yarn, consisting of a single endless fiber, generally made without twisting, which has a diameter of at least 0.08 mm. It differs from single filaments or capillaries, which make up a multifilament yarn, in particular by the considerably greater diameter; also, the properties and techniques for processing monofils differ in many respects from the properties and processing methods of multifilament yarns.

Monofils are used chiefly for making technical articles, particularly fabrics used for industrial purposes, in contrast to multifilament yarns, which find use mainly in the textile industry.

In most cases, monofils for industrial applications are subjected to high mechanical stresses in use. Added to this, in many cases, are thermal stresses and stresses due to chemical or other ambient influences to which the material must offer sufficient resistance. In all of these stresses, the material must have good dimensional stability and constancy of stress-strain properties over periods of time which are as long as possible. The use of monofils in papermaking machine screens, particularly in the Fourdrinier, of the press section and the dry section, places great demands on the monofil material. Not only high initial moduli and high tear strength, but also good knot and loop strength and high abrasive resistance are required, as is high resistance to hydrolysis; in addition, the service life of the screen should be as long as possible.

It is known that papermaking machine screens may be made of polyethylene terephthalate monofils in the warp and a combination of polyethylene terephthalate and polyamide-6 or polyamide-6,6 monofils in the weft. Such screens, however, may have the disadvantage that, in the course of the life of the screen on the papermaking machine, they lengthen in the direction of travel and therefore must be retightened.

There has been no lack of attempts to produce synthetic monofils that are suitable for a wide variety of applications, in particular including for the manufacture of papermaking machine screens. Thus, the use of copolymers based on 1,4-dimethylcyclohexane, terephthalic acid and isophthalic acid is described as an alternative to polyethylene terephthalate in U.S. Pat. No. 5,169,499. Although these polymers have good hydrolytic stability, they exhibit comparatively poor longitudinal, knot and loop strength.

Described in EP-0,761,847 A2 are papermaking machine screens which contain monofils of copolymers containing 85 to 99 mol-percent of the recurrent structural unit of Formula I

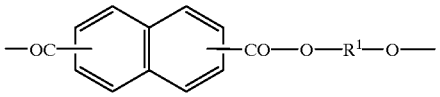

(I)

and 1 to 15 mol-percent of the recurrent structural unit of Formula II, $$—OC—R^2—CO—O—R^3—O— \quad (II)$$

where $R^1$ is a group of a dihydric aliphatic or cycloaliphatic alcohol or is derived from mixtures of such alcohols, $R^2$ represents a group of an aliphatic, cycloaliphatic or mononuclear aromatic dicarboxylic acid or is derived from mixtures of such dicarboxylic acids, $R^3$ assumes one of the meanings defined for $R^1$, and quantity indications are referred to the total quantity of the polymer.

The monofils described there are characterized by valuable properties, but are still capable of improvement with regard to splitting behavior and transverse strengths.

Monofils based on polyethylene terephthalate which contain admixtures of liquid crystalline polymers, are described in U.S. Pat. No. 5,692,938. The monofils described there exhibit improved abrasion resistance and are particularly suitable for making screens for papermaking machines.

However, the distribution of liquid crystalline polymers in polyethylene terephthalate is problematic, since the polymers have a tendency to distribute themselves in the matrix in the form of droplets, which is reflected, among other things, in an increased tendency to split. Attempts have long been made to solve this longstanding problem by, among other things, a method as described in U.S. Pat. No. 5,174,778, viz., by processing a mixture of polyalkylene terephthalate, a liquid crystalline polyester and a poly(O)- or —(N)-epoxyalkyl-substituted cyclic amide, imide or imidate, in particular triglycidyl isocyanurate.

Apart from the fact that processing such reactive mixtures creates problems, no suggestion that such mixtures may be processed to make monofils is to be found in said patent.

Thus, a need still exists for monofils with improved properties which lend themselves to multiple technical applications.

The object of the invention therefore is to make available monofils which, in particular, have improved cross strength and which have a high modulus and are largely resistant to hydrolysis.

The monofils of the present invention can be formed by intermixing in the melt polyethylene2,6-naphthalate and one or more liquid crystalline polymer in the specified concentrations, and optionally polybutylene terephthalate and inhibitors and additives, extruding the melt through a spinnert, and cooling and stretching the extrudate to form monofilaments having a diameter of 0.08 to 1.5 mm.

The monofils according to the invention may be produced in the following fashion:

The starting products, namely polyethylene-2,6-naphthalate and the liquid crystalline polymer as well as optionally polybutylene terephthalate and inhibitors, as well as additional additives, are dried immediately before spinning, preferably by heating in a dry atmosphere under vacuum. These raw materials are homogeneously intermixed and then melted in an extruder at a melting temperature of 270 to 320° C., preferably 290 to 305° C., filtered in a spinning pack and spun through a spinneret.

After leaving the spinneret the emerging extruded filaments (monofils) are cooled (rapidly chilled) in a spinning bath at about 70° C. water temperature and wound up or drawn off at a rate that is greater than the extrusion rate of the melt. The spinning lag is 1:1.5 to 1:6.0, preferably 1:3 to 1:5, the draw-off rate is 5 to 30 m/min, preferably 10 to 20 m/min.

Then, the strand (monofil) so produced is after-stretched, preferably in a number of steps, in particular is after-stretched in one, two or three steps, with a total stretch ratio of 1:4 to 1:8, preferably 1:5 to 1:7 and then heat-set at temperatures of 190 to 250° C., preferably 200 to 230° C.

Mechanical properties such as initial modulus, maximum tensile force, maximum tensile elongation, but also loop strength and knot strength, as well as shrinkage, may be influenced by means of stretching. Of course, the titer of the resultant monofil also depends upon stretching. Feed and stretching are coordinated so that, at the end, the monofils produced have a diameter of at least 0.08 mm. According to the invention, diameters of for example 0.08 to 1.5 mm may be selected.

The polyethylene-2,6-naphthalate used generally has a molecular weight of 25,000 to 30,000 g/mol corresponding to a relative viscosity of 1.80 to 1.90, measured as 1 wt-/vol-percent solution in dichloroacetic acid.

A preferred liquid crystalline polymer of use in the present invention is a polycondensation product based on p-hydroxybenzoic acid and 2,6-hydroxynaphthoic acid. For instance, the polycondensation product can be formed from 70 to 80 (preferably 72 to 74) mole percent p-hydroxybenzoic acid and 20 to 30 (preferably 26 to 28) mole percent of 2,6-hvdroxybenzoic acid.

Inhibitors optionally can be included in the monofils in a concentration of up to 3 weight percent. For instance, a carbodiimide inhibitor can be selected. Such carbodiimide can be a monocarbodiimide, a polycarbodiimide, or a mixture of monocarbodiimide and polycarbodiimide. A monocarbodiimide can be present in the monofil in a concentration of 0.4 to 1 weight percent and preferably in a concentration of 0.45 to 0.6 weight percent. A polycarbodiimide can be present in the monofil in a concentration of 0.15 to 2.25 weight percent and preferably in a concentration of 0.75 to 1.8 weight percent.

The addition of inhibitors makes it possible to mask the terminal groups of the polyester used and thus to stabilize the polymer. This is especially advantageous when the monofils produced are used for making papermaking machine screens or cloth and high demands are placed on hydrolytic stability in particular.

The addition of polybutylene terephthalate makes it possible to improve mechanical properties such as knot strength still further. The polybutylene terephthalate can be present in the monofilament in a concentration up to 15 percent by weight, preferably is provided in a concentration of 3 to 12 percent by weight, and most preferably in a concentration of 4 to 11 percent by weight. The polyethylene terephthalate used generally has a molecular weight of 25,000 to 30,000 g/mol corresponding to a relative viscosity of 1.0 to 2.3, measured as 1 wt-/vol-percent solution in dichloroacetic acid.

In addition to the constituents already mentioned, the mixture to be spun may contain further added materials or additives. Thus, of course, catalytic residues coming from polycondensation, such as antimony trioxide and tetra-alkoxytitanate, may be added. Processing aids or lubricating agents such as siloxanes may also be used.

The monofils may alternatively contain inorganic or organic pigments or dulling agents, stabilizers and, in particular, flameproofing agents such as appropriate phosphorous compounds.

The monofils of the present invention can be used to advantage in the manufacture of screens, filters, reinforcing elastomers, and conveyor-belt fabrics. For instance, papermaking machine screens or cloth can be formed, as well as conveyor-belt fabrics, and screens or filters for the food processing industry.

The monofils according to the invention may be processed in the usual fashion, so the monofils may be woven on conventional wide looms to make papermaking machine screens. The monofils according to the invention may alternatively be processed together with other monofils such as polyamide monofils or polyethylene terephthalate monofils.

The production parameters and properties of four monofils according to the invention are listed in the following table.

TABLE

| | | Example 1 | Example 2 | Example 3 | Example 4 |
|---|---|---|---|---|---|
| Raw material | | 100% PEN | 98% PEN | 93% PEN | 92.4% PEN |
| Additive 1 | | | + 2% LCP | + 2% LCP | + 2% LCP |
| Additive 2 | | | | + 5% PBT | + 5% PBT |
| Additive 3 | | | | | + 0.6% Carbodiimide |
| Diameter | [mm] | 0.50 | 0.50 | 0.50 | 0.50 |
| Feed | [g/min] | 261 | 261 | 260 | 260 |
| Bulk temperature | [° C.] | 295 | 295 | 295 | 295 |
| Spinning bath temperature | [° C.] | 70 | 70 | 70 | 70 |
| Draw-off rate | [m/min] | 15 | 15 | 15 | 15 |
| Feed temperature | [° C.] | 220 | 220 | 220 | 220 |
| Tear strength | [cN/tex] | 41 | 44 | 43 | 43 |
| Elongation at tear | [%] | 15 | 14 | 15 | 17 |
| Modulus | [N/tex] | 12 | 13 | 13 | 13 |
| Shrinkage at 180° C. | [%] | 2.5 | 2.5 | 2.5 | 2.5 |
| Knot strength | [cN/tex] | 8 | 18 | 23 | 25 |
| Loop strength | [cN/tex] | 5 | 7 | 8 | 14 |
| Tear strength after hydrolysis (80 hrs at 135° C.) | [%] | 75 | 78 | 66 | 77 |

What is claimed is:

1. A monofilament that exhibits enhanced knot strength formed by the melt extrusion of a polymer blend of 60 to 99.9 weight percent of polyethylene-2,6-naphthalate, and 0.1 to 10 weight percent of liquid crystalline polymer.

2. A monofilament that exhibits enhanced knot strength according to claim 1 having a diameter of at least 0.08 mm.

3. A monofilament that exhibits enhanced knot strength according to claim 1 having a diameter of 0.08 to 1.5 mm.

4. A monofilament that exhibits enhanced knot strength according to claim 1 wherein said polyethylene-2,6-naphthalate has a molecular weight of 25,000 to 30,000.

5. A monofilament that exhibits enhanced knot strength according to claim 1 wherein said liquid crystalline polymer is a polycondensation product based on p-hydroxybenzoic acid and 2,6-hydroxynaphthoic acid.

6. A monofilament according to claim 1 wherein said liquid crystalline polymer is a polycondensation product of 70 to 80 mole percent of p-hydroxybenzoic acid and 20 to 30 mole percent of 2,6-hydroxynaphthoic acid.

7. A monofilament according to claim 1 wherein said liquid crystalline polymer is a polycondensation product of 72 to 74 mole percent p-hydroxynaphthoic acid and 26 to 28 mole percent of 2,6-hydroxynaphthoic acid.

8. A monofilament that exhibits enhanced knot strength according to claim 1 wherein said liquid crystalline polymer is present in said blend in a concentration of 0.5 to 7 weight percent.

9. A monofilament that exhibits enhanced knot strength according to claim 1 wherein said liquid crystalline polymer is present in said blend in a concentration of 1 to 5 weight percent.

10. A monofilament that exhibits enhanced knot strength according to claim 1 wherein said blend additionally contains up to 15 weight percent of polybutylene terephthalate.

11. A monofilament that exhibits enhanced knot strength according to claim 1 wherein said blend additionally contains 3 to 12 weight percent of polybutylene terephthalate.

12. A monofilament that exhibits enhanced knot strength according to claim 1 wherein said blend additionally contains 4 to 11 weight percent of polybutylene terephthalate.

13. A monofilament that exhibits enhanced knot strength according to claim 1 wherein said blend additionally contains up to 3 weight percent of a carbodiimide inhibitor.

14. A monofilament that exhibits enhanced knot strength according to claim 1 wherein said blend additionally contains 0.15 to 2.25 weight percent of a polycarbodiimide inhibitor.

15. A monofilament that exhibits enhanced knot strength according to claim 1 wherein said blend additionally contains 0.4 to 1 weight percent of monocarbodiimide.

16. A monofilament that exhibits enhanced knot strength according to claim 1 wherein said blend additionally contains 0.45 to 0.6 weight percent of monocarbodiimide inhibitor.

17. A monofilament that exhibits enhanced knot strength according to claim 1 wherein said blend additionally contains 0.15 to 2.25 weight percent of a polycarbodiimide inhibitor.

18. A monofilament that exhibits enhanced knot strength according to claim 1 wherein said blend additionally contains 0.75 to 1.8 weight percent of a polycarbodiimide inhibitor.

19. A monofilament that exhibits enhanced knot strength according to claim 13 wherein said inhibitor is a mixture of a monocarbodiimide and a polycarbodiimide.

20. A monofilament that exhibits enhanced knot strength according to claim 1 that was drawn subsequent to said melt extrusion.

21. A fabric having improved mechanical properties that includes monofilament of claim 1.

* * * * *